US005671613A

United States Patent [19]

Hoover et al.

[11] Patent Number: 5,671,613

[45] Date of Patent: Sep. 30, 1997

[54] GEM SETTING HAVING NOTCHED PRONGS

[75] Inventors: Torrance D. Hoover; Frederick Walter Klotz; Stephen D. Stickley, all of Midlothian, Va.

[73] Assignee: Hoover & Strong, Incorporated, Richmond, Va.

[21] Appl. No.: 541,596

[22] Filed: Oct. 10, 1995

[51] Int. Cl.[6] ..... A44C 17/02

[52] U.S. Cl. ..... 63/27; 63/26

[58] Field of Search ..... 63/26, 27, 31

[56] References Cited

U.S. PATENT DOCUMENTS

| | | | |
|---|---|---|---|
| 733,263 | 7/1903 | Nordt . | |
| 832,887 | 10/1906 | Wittstein . | |
| 873,156 | 12/1907 | Moe . | |
| 881,802 | 3/1908 | Hunt . | |
| 962,305 | 6/1910 | Buser . | |
| 1,056,414 | 3/1913 | Hexter . | |
| 1,121,296 | 12/1914 | Schmidt . | |
| 1,166,431 | 1/1916 | Capwell . | |
| 1,971,265 | 8/1934 | King . | |
| 2,003,950 | 6/1935 | Pejchar . | |
| 2,200,841 | 5/1940 | Gaertner . | |
| 2,377,222 | 5/1945 | Fruth . | |
| 2,749,597 | 6/1956 | Fus . | |
| 2,811,024 | 10/1957 | Thompson | 63/26 |
| 3,014,354 | 12/1961 | McCary | 63/27 |
| 4,258,458 | 3/1981 | Danna . | |
| 4,972,685 | 11/1990 | Pöll . | |
| 5,218,839 | 6/1993 | Udko . | |

FOREIGN PATENT DOCUMENTS

| | | | |
|---|---|---|---|
| 2218319 | 11/1989 | United Kingdom | 63/27 |

*Primary Examiner*—Blair Johnson

*Attorney, Agent, or Firm*—Beveridge, DeGrandi, Weilacher & Young LLP

[57] ABSTRACT

A gem setting includes a base and prongs. Each of the prongs has a notch shaped for holding a portion of a gem girdle, such that when a gem having a crown is set into the setting, the upper portion of the notch extends over the crown of the gem. Each prong also has an upper part above the notch, which may be permanently bent over the crown of the gem to secure the gem in the setting. A method of setting a gem in the setting includes stabilizing the gem at a fixed location, and then moving the gem and setting together, without permanently bending the prongs, until the gem positioned within the setting such that, if the gem and setting together are placed in an upside down position, the gem will not fall out of the setting. Next, the upper part of each prong is permanently bent over the crown of the gem, to thereby secure the gem in the setting.

18 Claims, 3 Drawing Sheets

GEM SETTING HAVING NOTCHED PRONGS

BACKGROUND

1. The Field of the Invention

The invention relates to a jewelry setting for gems, such as round facet-cut diamonds. The ready-made setting has a number of prongs, with notches cut into the prongs. The notches are shaped so that the girdle of the gem is securely held in the notch.

2. The Prior Art

Throughout history, gemstones such as diamonds have been cut and polished to form gems, and then set in rings, earrings, and other objects to form jewelry. One cut that is currently popular for such gems is the round facet cut, or brilliant cut, shown in FIG. 1. This cut divides the gemstone 10 into an upper portion, known as the crown 11, and a lower portion, referred to as the pavilion 12. The circumference of the gem where the crown meets pavilion is called the girdle 13.

A variety of gem settings have been employed to securely hold such gems in jewelry. One of the most popular types of gem settings is the prong type setting. One advantage of the prong setting is that this type of setting allows the gem to be exposed to more light than other types of settings, such as bezel settings.

Conventionally, two types of prong settings are used to hold gems. The first type of prong setting 20, shown in FIG. 2, has solid prongs 21 without any cuts or deformations. With this type of setting, the jeweler cuts notches in each of the prongs which correspond with the girdle of the gem. The jeweler then places the gem in the prongs, so that the girdle of the gem is held in the notches. The portion of the prongs above the notches are then bent over the crown of the gem with jeweler's pliers.

With this type of setting, the notches must be carefully aligned on the prongs so that they will hold the gem at a level position. Also, the shape of the notches must be carefully cut with hand tools, such as a motorized bur, to match the shape of the gem girdle. Thus, this type of setting can only be used by a skilled jeweler.

A variation of this type of setting is a prong setting with pre-cut guide grooves, as shown in FIG. 3. In this type of gem setting, guide grooves 30 are cut into each of the prongs 31. These guide grooves 30 relieve the jeweler of the task of aligning the notches at a level plane on the prongs. However, the jeweler must still cut the grooves to precisely match the shape of the girdle. Only a skilled jeweler can use this type of setting as well.

Yet another type of setting with guide notches may be found in, for example, U.S. Pat. No. 832,887 to Wittstein, U.S. Pat. No. 962,305 to Buser, U.S. Pat. No. 2,200,841 to Gaertner, and U.S. Pat. No. 4,258,458 to Danna. The guide notches in this type of setting may assist the jeweler to balance the gem in the setting by providing a surface (i.e., the bottom of the grooves) which better matches the shape of the gem than the sides of the prongs. These guide grooves may also facilitate the bending of the prongs, and help to ensure that the prongs are bent evenly. However, even with these guide grooves, the jeweler setting the gem would still have to carefully balance the gem in the grooves until the prongs are bent over the gem. The grooves alone do not hold the gem securely in place.

Yet another type of gem setting has prongs with deeper grooves, which securely hold the gem in the setting.

Examples of this type of setting may be found in U.S. Pat. No. 873,156 to Moe, U.S. Pat. No. 1,971,265 to King, U.S. Pat. No. 2,003,950 to Pejchar, U.S. Pat. No. 2,377,222 to Fruth, U.S. Pat. No. 2,749,597 to Fus, U.S. Pat. No. 4,972,685 to Pöll, and U.S. Pat. No. 5,218,839.

In this type of setting, the gem is held only by the shape of the groove. The remainder of the prong, particularly the portion of the prong above the groove, is not used to help hold the gem in the setting. Thus, if the shape of the groove does not exactly match the shape of the gem, the gem will not be securely held in the setting.

SUMMARY OF THE INVENTION

It is an object of the present invention to address the disadvantages of the prior art settings. It is another object of the invention to provide a gem setting in which a jeweler, or even an unskilled layman, may easily and quickly set a cut gem such as a diamond. More particularly, it is an object of the invention to provide a ready-made prong setting which safely maintains the gem at the desired position in the setting until the prongs of the ready-made setting can be tightened (i.e., bent down over the gem) to securely hold the gem in the setting.

It is yet another object of the invention to provide a ready-made gem setting which produces an audible sound to alert the person setting the gem that the gem is being maintained at the desired position in the setting.

Yet another object of the invention is to provide a method for making a ready-made gem setting having preformed notches formed by diestriking. It is yet another object of the invention to provide a method for making a ready-made gem setting having preformed notches formed by burring with an automated burring device.

In order to fulfill the objects of the invention, a ready-made setting is provided which includes a base and a plurality of resilient prongs extending upward from the base. Each of the prongs defines a preformed notch in a notch plane, each notch facing toward a middle of the base.

Each preformed notch is substantially identical to the other preformed notches. That is, the notches are as similiar to each other as can be achieved by the machining tolerances of the diestriking process when a diestrike method is employed to form the notches. Alternately, the notches will be as similiar to each other as can be achieved by the machining tolerances of modern automated burring process when an automated burring method is employed to form the notches.

Each notch includes an upper portion and a lower portion which are shaped for holding a portion of a gem girdle therebetween, such that when a gem having a crown is set into the setting, the upper portion of the preformed notch extends over the crown of the gem. Each prong is divided by the notch into an upper part above the notch and a lower part below the notch, such that the upper part may be permanently bent over the crown of the gem to secure the gem in the setting.

In one preferred embodiment of the invention, each notch extends into the prong to a depth of approximately thirty percent (30%) to forty-five percent (45%) of the total depth of the prong. More particularly, each notch extends into the prong to a depth of approximately forty percent (40%) of the total depth of the prong.

A gem having a crown and pavilion is securely set in the setting by first stabilizing the gem at a fixed location, and then positioning the setting relative to the gem such that a plane of the gem girdle is substantially parallel to the notch plane. Next, the setting is brought down over the gem, without permanently bending the prongs, until the gem positioned within the setting such that, if the gem and setting together are placed in an upside down position, the gem will not fall out of the setting. Lastly, the top part of each prong is permanently bent over the crown of the gem, to thereby secure the gem in the setting.

The setting according to one embodiment of the invention may be made by forming the notches by a diestriking process employing a die. Preferrably, the die employed in the diestriking process is shaped so as to correspond with a shape of a gem girdle. Alternately, the setting according to another embodiment of the invention may be made by forming the notches by burring the notches into the prongs with an automated burring device.

These and other objects and features of the invention will become more apparent from the following description, made with reference to the accompanying drawings.

DETAILED DESCRIPTION OF PREFERRED EMBODIMENTS OF THE INVENTION

Figure 1:
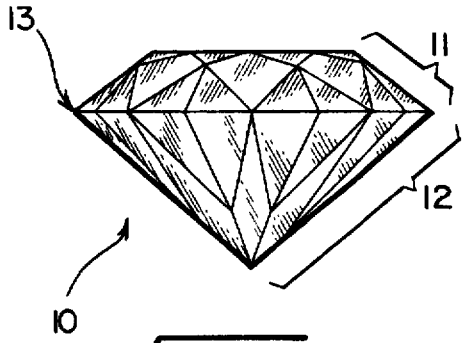
FIG. 1 is schematic illustration of a brilliant cut gem.
Figure 2:
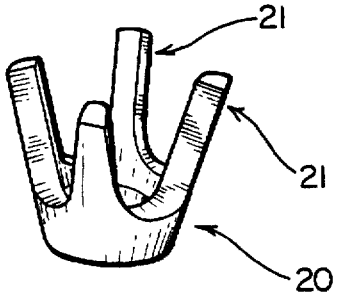
FIG. 2 (PRIOR ART)
FIG. 2 is a conventional setting for gems.
Figure 3:
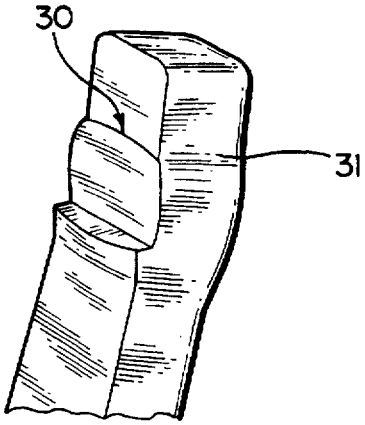
FIG. 3 (PRIOR ART)
FIG. 3 is a perspective view of a prong for a conventional gem setting.
Figure 4:
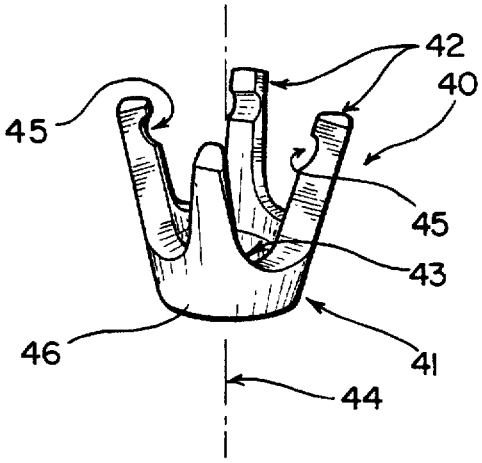
FIG. 4 is a perspective view of a ready-made setting for gems according to one embodiment of the invention.

A first embodiment of the invention is shown in FIG. 4. In this embodiment, the ready-made setting 40 is formed of a base 41 and prongs 42. The base 41 is formed of circlet 46, which encircles a middle region 43. In a preferred embodiment, the diameter of the circlet 46 increases from the bottom of the base 41 to the top of the base 41. The bottom of the base 41 may be open, thereby giving the base 41 a crown shape. Alternatively, the bottom of the base 41 may be closed, providing the base 41 with a bowl shape.

Four prongs 42 extend upwardly from the base 41. Preferably, the prongs 42 are slightly angled away from the middle 43 of the base 41, in order to better correspond with the shape of the gem. Since the base 41 of the ready-made setting 40 is a circlet 46, it will be understood that there is a central axis 44 running through the middle 43 of the base 41. In the embodiment of the invention shown in FIG. 4, the prongs 42 are equidistant from the central axis 44, and are spaced around the central axis 44 at equal intervals of 90°.

It should be noted that the prong arrangement shown in FIG. 4 is for setting a symmetrical gem, such as a round cut diamond. However, it will be understood that other embodiments are well within the scope of the invention. For example, the number of prongs 42 can be increased or decreased, depending upon the shape of the gem to be set. Also, the prongs 42 can be arranged unequally about the central axis 44, and at different distances from the central axis 44. Those of ordinary skill in the art will appreciate how to modify the embodiments of the invention disclosed herein, in order to securely set a range of gem shapes and sizes.

Describing the prongs 42 in more detail, a notch 45 is cut in each of the prongs 42. Each notch 45 is substantially identical to the other notches 45, as will be explained when the method of forming the ready-made setting is discussed. The notch 45 in each prong 42 is cut toward the top of the prong 42, thereby dividing the prong 42 into three parts. That is, as shown in more detail in FIG. 5, each prong 42 has a lower part 50 below the notch 45, a notch part 51 adjacent the notch 45, and an upper part 52 above the notch 45. The notches 45 are positioned so as to define a single plane, hereafter referred to as the notch plane. In a preferred embodiment, the notch plane is parallel to the circlet 46. However, other embodiments are of course possible where the notch plane is at a skew to the circlet 46. Each notch 45 faces inward, toward the central axis 44.

Figure 5:
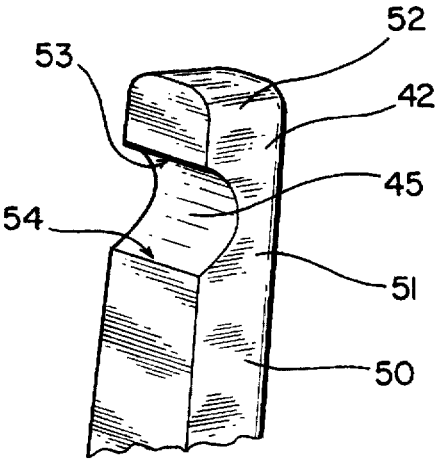
FIG. 5 is a perspective view of a prong of the setting according to the invention shown in FIG. 4.

As can be seen from FIG. 5, each notch 45 is concave and includes an upper portion 53 and a lower portion 54. The upper portion 53 and lower portion 54 of the notch 45 are shaped so as to securely hold a portion of a girdle of a gem between them. That is, while the notches 45 are round, the curve of the notches 45 is cut so that the upper portion 53 is shown to have a different radius of curvature than the lower portion 54 so as to provide the notch with a profile which generally corresponds to the angle between the crown 11 and the pavilion 12 of the gem to be held in the ready-made setting. Alternate embodiments are also possible, however, where the notches 45 are shaped to more closely correspond to the angle between the crown 11 and the pavilion 12.

Also, the notches 45 are cut deeply enough into the prongs 42 such that a sufficient portion of the gem crown 11 is covered by the upper portion 53 of each notch 45. By the term "sufficient", it is meant that, when a gem 10 is placed in the ready-made setting 40, enough of the crown 11 is covered by the upper portions 53 of the notches 45 that the upper portions 53 hold the gem 10 in position relative to the ready-made setting 40, without permanent bending of the prongs 42. Thus, the gem 10 is held in its proper position in the ready-made setting 40, even if the ready-made setting 40 is subsequently tilted or turned upside down.

In the embodiment of the invention shown in FIG. 4, the notches 45 are cut into the prongs 42 to a depth of between approximately thirty percent (30%) to forty-five percent (45%) of the depth of the prong 42. More preferably, the notches 45 are cut into the prongs 42 to a depth of approximately forty percent (40%) of the depth of the prong 42. Approximately, as used above, is intended to convey that the notches are within three percent of the stated depth. However, it will be understood that when more prongs 42 are employed, the depth of each notch 45 may be shallower. Alternatively, if fewer prongs 42 are employed, the depth of each notch 45 may be deeper.

As described above, when a gem 10 is positioned in the setting 40, the prongs 42 are resilient enough to be pushed back by the gem 10 without becoming permanently bent. When the gem 10 is correctly positioned in the ready-made setting 40, the prongs 42 move back toward their original position, and may even return to their original position. However, the notch 45 in each of the prongs 42 holds a portion of the gem's girdle 13.

Because each prong 42 is located at equally spaced intervals around the central axis 44, the girdle 13 of the set gem 10 is held at the juxtaposed locations of the prongs 42, thereby holding the gem 10 at a fixed position in the setting 40. Thus the ready-made setting 40 may be tilted and even turned upside down without shifting the gem 10 from its proper position in the ready-made setting 40. Since the gem 10 is held in a fixed position, the upper parts 52 of the prongs 42 can then be easily and permanently bent over the top of the gem's crown 11, to secure the gem 10 in the setting 40.

Figure 6A:
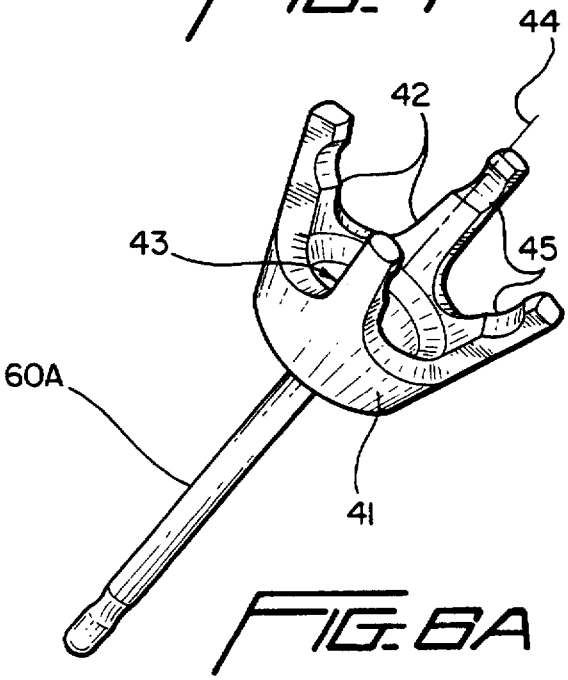
FIGS. 6A and 6B illustrate perspective views of alternate embodiments of gem settings according to the invention.
Figure 6B:
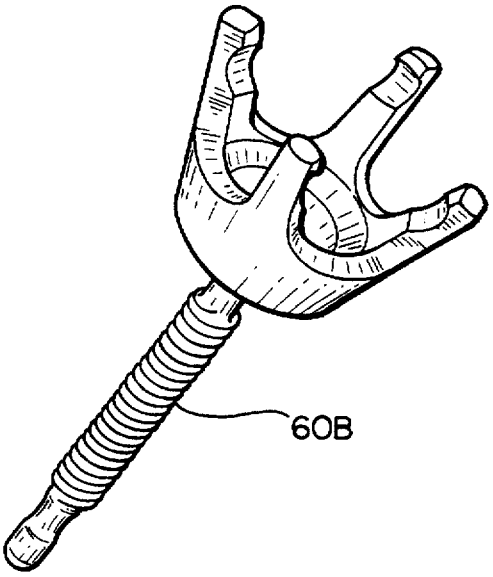

The above-described embodiment of the invention is a ready-made setting for use with a ring or the like. However, alternate embodiments of the invention, such as pendants or for earrings, are shown in FIGS. 6A and 6B. The ready-made settings 40 in these embodiments are similar to the embodiment described above, but they further include earring posts 60A and 60B, respectively. The earring post 60A of the embodiment shown in FIG. 6A is conventional earring post, for fitting into a typical push-on type backing. The earring post 60B of the embodiment shown in FIG. 6B is threaded, for screwing into a threaded backing.

The method of mounting the gem 10 in the ready-made setting 40 will now be described with reference to FIGS. 7–12. This method is described with reference to the earring embodiment of the setting 40 shown in FIG. 6A, but is generally applicable to all of the embodiments of the invention described above.

Figure 7:
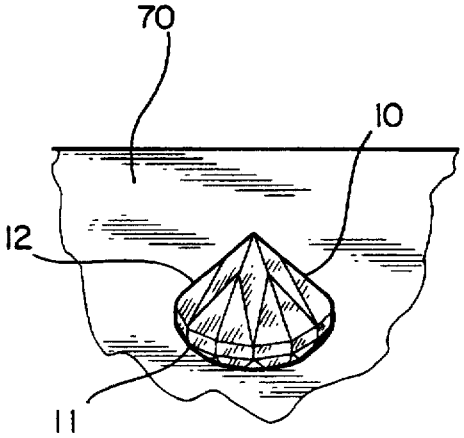
FIG. 7–12 illustrate the various steps of one method of securing a gem in a ready-made setting according to an embodiment of the invention.

First, a ready-made setting 40 is selected which corresponds to the size of the gem 10. Next, the gem 10 is held in a stabilized position by placing it on flat stable surface 70. In this position, the top of the crown 11 rests on the surface 70, and its pavilion 12 points upwards, as shown in FIG. 7.

Figure 8:
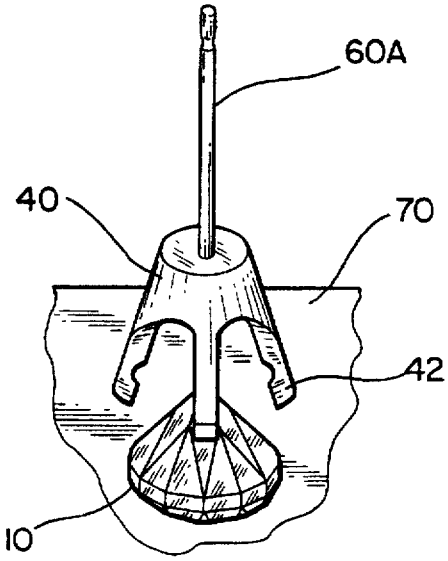

Then, the ready-made setting 40 is positioned over the gem 10, with the prongs 42 facing downward, as shown in FIG. 8. Preferably, the setting 40 should be positioned so that the central axis of the ready-made setting 40 passes through the center of the gem 10. Next, the ready-made setting 40 is brought downward, over the pavilion of the gem 10. As this occurs, the gem 10 flexes the prongs 42 outward, away from the gem 10.

Figure 9:
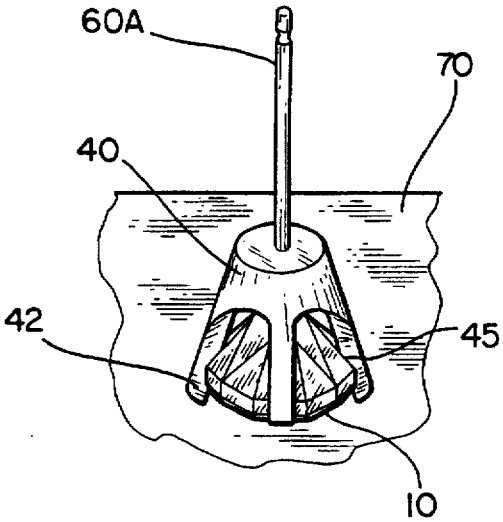

As the ready-made setting 40 continues to be brought downward, a portion of the girdle of the gem 10 is positioned in each of the notches 45, as shown in FIG. 9. The prongs 42 are resilient enough such that, when this occurs, the prongs 42 move back toward their original position, and may even return to their original position. That is, the prongs 42 are resilient such that they are not permanently bent when flexed outward by the gem 10, but move to regain their original shape.

Further, with the embodiment of the invention described above, the positioning of the girdle 13 in each of the notches 45 will produce an audible click. When a portion of the girdle 13 is positioned in each of the notches 45, the gem 10 is held in position in the setting 40. Thus, the ready-made setting 40 can be tilted and even turned over without moving the gem 10 relative to the ready-made setting 40.

Figure 10:
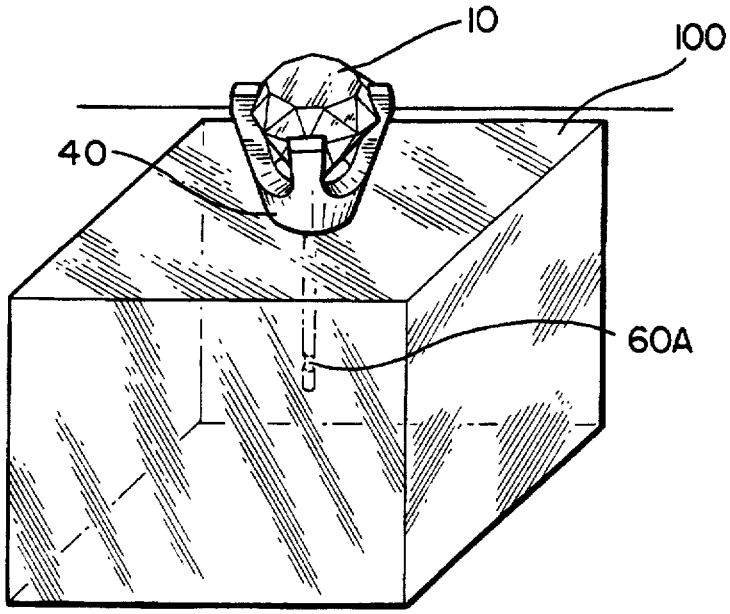

Next, the setting 40 (with the gem 10 mounted therein) is turned upright, so that the prongs 42 and the crown 11 both face upward, and then the ready-made setting 40 is stabilized in this position. For example, with the earring setting embodiments of the invention shown in FIGS. 6A and 6B, the ready-made setting 40 can be stabilized in this upright position by placing the post (60A or 60B) in a hole drilled in a block 100, as shown in FIG. 10. Other arrangements for fixing the ready-made setting 40 in the upright position are, of course, possible.

Figure 11:
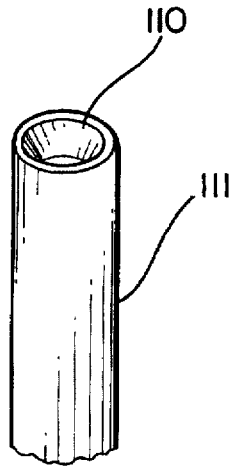
Figure 12:
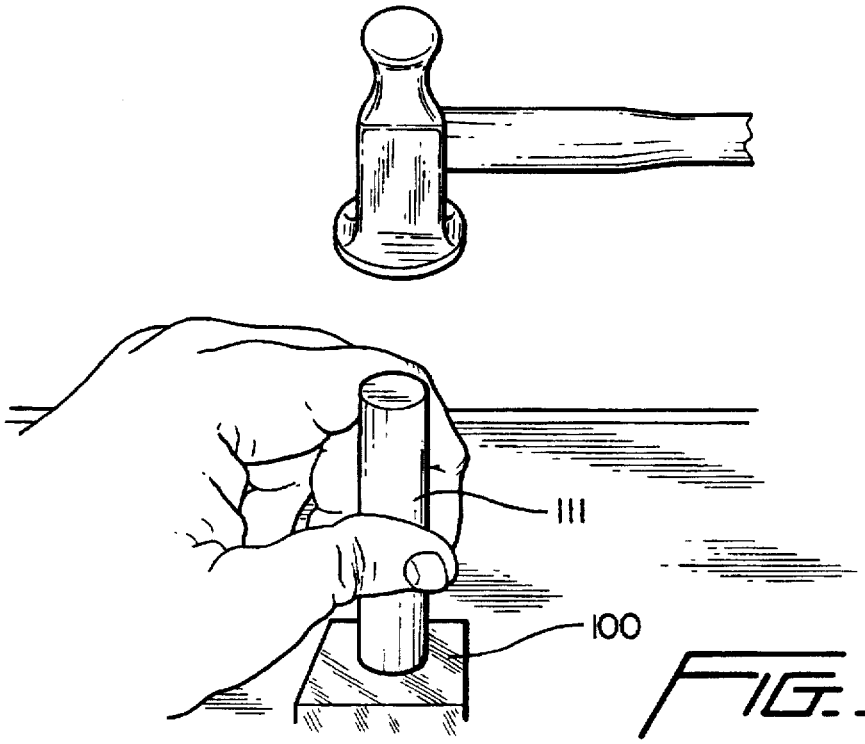

Once the setting 40 has been stabilized in the upright position with the gem 10 securely held between the prongs 42, the prongs' hold on the gem 10 is then tightened by permanently bending the upper parts 52 of the prongs 42 over the top of the crown 11. Preferably, this tightening is done by forcing a conical surface over the top of the prongs 42. As shown in FIG. 11, the conical surface is formed of a depression 110 in one end of a punch tool 111. With this arrangement, the conical depression 110 in the end of the punch 111 is placed over the top of the prongs 42, and the other end of the punch 111 is then lightly tapped with a hammer or the like, as shown in FIG. 12. It should be noted that the notches 45 of the ready-made setting 40 hold the gem 10 in a fixed position while the prongs 42 are tightened around the gem 10.

Those of ordinary skill in the art will appreciate that the application of too much force to the punch 111 will bend the lower parts 50 of the prongs 42 below the notch 45, and may even damage the gem 10. However, when the proper amount of force is applied to the punch 111, the upper parts 52 of the prongs 42 are bent over the top of the crown 11 of the gem 10, securing the gem 10 in the ready-made setting 40. Also, the shapes of the notches 45 are changed to better correspond with the shape of the girdle 13, which also causes the gem 10 to be more securely held in the ready-made setting 40.

The proper amount of force to be applied to the punch tool 111 will vary depending upon, for example, the material employed for the setting 40, and the size and shape of the gem 10 and the ready-made setting 40. However, the proper amount of force can be quickly determined by those of ordinary skill in the art without undue experimentation.

It should be noted that other methods of setting a gem 10 in the ready-made setting 40 are possible. For example, rather than stabilizing the gem 10 and bringing the ready-made setting 40 down over the gem 10, the setting 40 may instead be stabilized. With this alternate method, the gem 10 is then moved down into the ready-made setting 40 until a portion of the girdle 13 of the gem 10 is positioned in each of the notches 45.

Preferably, the ready-made setting 40 according to the invention is formed by a conventional diestriking process. In such a process, the ready-made setting 40 is punched out of a sheet of material by a punch, or die. The striking force of the die serves to compress the material of the setting 40, improving its strength by the process. In particular, the notches 45 are formed by such a diestriking processes. The die used to form the notches 45 is shaped to correspond with the shape of the girdle 13 of a gem sized to be set into the ready-made setting 40.

Alternatively, the notches 45 may be formed by a conventional automated burring process. In such a process, the notches 45 are cut into the prongs 42 by an automated burring device, rather than by a handheld burring device. Again, the notches 45 are cut to correspond with the shape of the girdle 13 of a gem sized to be set into the ready-made setting 40.

In a preferred embodiment, the notches 45 of the ready-made setting 40 are formed so as to be identical with one another. That is, when the notches 45 are formed by a diestriking process, they are formed as similiar to each other as they can be by machining tolerances of the diestriking process. Likewise, when the notches 45 are formed by an automated burring process, they are formed as similiar to each other as they can be by the machining tolerances of the automated burring process. Both a diestriking process and an automated burring process will provide a degree of similiarity between the notches 45 which is greater than can be obtained by conventional handcutting process currently employed by jewelers.

Preferrably, the ready-made setting 40 is constructed out of conventional setting materials, such as platinum, gold alloys, and palladium alloys. The formation of these materials is well known in the art.

While the embodiments of the invention described herein are settings for a round cut gem, it will be appreciated that the size and shape of the ready-made setting can be changed to securely hold gems with other shapes, without departing from the spirit and scope of the invention.

The invention may be embodied in other forms without departing from either the spirit or the scope of the invention. Therefore, it is intended that the scope of the invention will be defined by the appended claims, rather than by any specific embodiment of the invention disclosed above.

What is claimed is:

1. A ready-made gem setting for holding a gem having a crown, a pavilion, and a girdle, comprising:

a base; and a plurality of resilient prongs extending upward from the base, each of the prongs defining concave notch means in a notch plane, each notch means facing toward a middle of the base and each notch means including a curved upper portion and a curved lower portion for holding a portion of the gem girdle therebetween, such that when a gem having a crown is set into the setting, the upper portion of each notch means extends over the crown of the gem to produce an audible sound and to hold the gem in the setting such that, if the gem and setting together are placed in an upside down position, the gem will not fall out of the setting, the upper portion of the notch means having a different radius of curvature than the lower portion of the notch means such that the notch means is shaped to correspond to a shape of a girdle of a gem to be set into the setting, each prong being divided into an upper part above the notch and a lower part below the notch, such that the upper part may be permanently bent over the crown of the gem to secure the gem in the setting.

2. A gem setting according to claim 1, wherein the notch means are substantially identical to each other.

3. A gem setting according to claim 1, wherein the notch means extend into the prong to a depth of approximately thirty percent (30%) to forty-five percent (45%) of the total depth of the prong.

4. A gem setting according to claim 1, wherein the notch extends means extend into the prong to a depth of approximately forty percent (40%) of the total depth of the prong.

5. A gem setting according to claim 1, wherein the prongs extend away from the middle of the base.

6. A gem setting according to claim 1, further including a post extending downward from the base.

7. A gem setting according to claim 6, wherein the post is threaded.

8. A gem setting according to claim 1, wherein the prongs are positioned equidistantly from the a central axis passing through the middle of the base.

9. A gem setting according to claim 1, having four prongs.

10. A gem setting according to claim 1, wherein the base is crown-shaped.

11. A gem setting according to claim 1, wherein the upper and lower portion of each notch means are shaped to provide a profile corresponding to a profile of a girdle of a facet-cut gem.

12. A gem setting according to claim 1, wherein the setting is formed of a gold alloy.

13. A gem setting according to claim 1, wherein the setting is formed of platinum.

14. A gem setting according to claim 1, wherein the setting is formed of a palladium alloy.

15. A method of setting a gem having a crown, a pavilion, and a girdle in a gem setting according to claim 1, comprising:

stabilizing the gem at a fixed location;

positioning the setting relative to the gem such that a plane of the gem girdle is substantially parallel to the notch plane;

moving the setting down over the gem, without permanently bending the prongs, until an audible noise is produced when the gem is positioned within the setting such that, if the gem and setting together are placed in an upside down position, the gem will not fall out of the setting; and permanently bending the upper part of each prong over the crown of the gem, to thereby secure the gem in the setting.

16. A method of setting a gem according to claim 15, wherein the top portions are bent by pushing the top portions against a conical surface or by pushing the conical surface against the top portions.

17. A method of setting a gem according to claim 16, wherein the setting includes a post extending downward from the base, and the setting is held fixed relative to the conical surface by securing the post.

18. A method of setting a gem in a setting according to claim 15, wherein the setting is positioned relative to the gem such that the gem pavilion faces the prongs.

* * * * *